US008534623B2

(12) United States Patent
Crow et al.

(10) Patent No.: US 8,534,623 B2
(45) Date of Patent: Sep. 17, 2013

(54) CONTAINER AND UNIVERSAL BRACKET SYSTEM

(75) Inventors: Tommi L. Crow, Asheville, NC (US); James Papafagos, North Java, NY (US); Todd Smith, Erie, PA (US); Gary Pozum, Kingsville, OH (US); Brian Mayo, Erie, PA (US)

(73) Assignee: Crow-Erickson, Inc., Asheville, NC (US)

( * ) Notice: Subject to any disclaimer, the term of this patent is extended or adjusted under 35 U.S.C. 154(b) by 0 days.

(21) Appl. No.: 13/205,244

(22) Filed: Aug. 8, 2011

(65) Prior Publication Data

US 2011/0290963 A1 Dec. 1, 2011

Related U.S. Application Data

(62) Division of application No. 11/742,900, filed on May 1, 2007, now Pat. No. 8,020,819.

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |
| ***E04G 5/06*** | (2006.01) |
| ***F21V 21/00*** | (2006.01) |
| ***F21V 35/00*** | (2006.01) |

(52) U.S. Cl.

USPC ..... 248/219.2; 248/219.1; 248/218.4; 40/607.01; 40/606.06; 40/607.09

(58) Field of Classification Search

USPC ..... 248/201, 202.1, 230.1, 218.4, 219.1, 248/907, 156, 207, 95, 318, 317, 309.1, 682; 40/1, 409, 606.01, 606.14, 607.01, 607.02, 40/607.06, 611.01, 606.03, 606.06, 607.09; 211/50, 87.01; 221/45; 232/17, 19, 28; 312/100, 101, 138.1

See application file for complete search history.

(56) References Cited

U.S. PATENT DOCUMENTS

| | | | | | |
|---|---|---|---|---|---|
| 1,631,904 | A | | 6/1927 | Warmack | |
| 1,656,426 | A | * | 1/1928 | Cunningham | 232/39 |
| 2,182,660 | A | * | 12/1939 | Edward | 248/201 |
| 2,315,158 | A | | 3/1943 | Markham | |
| 2,484,797 | A | * | 10/1949 | Agamaite, Jr. | 221/46 |
| 2,552,745 | A | * | 5/1951 | Stanley, Sr. et al. | 40/607.12 |
| 2,552,915 | A | | 5/1951 | Zachrich | |
| 2,578,693 | A | * | 12/1951 | Gieseler | 232/19 |
| 3,441,239 | A | * | 4/1969 | Frost | 248/545 |
| 3,519,234 | A | * | 7/1970 | Matson | 248/156 |
| 3,602,423 | A | * | 8/1971 | Corkery | 232/17 |
| 3,654,718 | A | | 4/1972 | Bianchi | |
| 3,738,606 | A | * | 6/1973 | Millen | 248/449 |
| 3,749,302 | A | * | 7/1973 | White | 232/19 |

(Continued)

*Primary Examiner* — Terrell McKinnon
*Assistant Examiner* — Michael McDuffie
(74) *Attorney, Agent, or Firm* — John G. Fischer, Esq.; Scheef & Stone, L.L.P.

(57) ABSTRACT

A container [10] is disclosed having a universal bracket system [300] that allows attachment of the container [10] to a plurality of upstanding outdoor supports including posts, angle iron, and signs supported in cylindrical frameworks. In the preferred embodiment, the container [10] has a box [100] with a lid [200] pivotally attached thereto. The box [100] has a bracket system [300] comprised of an upper bracket [310], a central bracket [320] and a lower bracket [340] which have complementary geometric relationships that facilitate attachment to the multiple structures.

10 Claims, 14 Drawing Sheets

(56) References Cited

U.S. PATENT DOCUMENTS

| | | | | | |
|---|---|---|---|---|---|
| 4,138,055 | A | * | 2/1979 | Harrison | 232/1 C |
| 4,232,467 | A | * | 11/1980 | Stewart | 40/607.11 |
| 4,233,769 | A | * | 11/1980 | Archer | 40/607.12 |
| 4,395,012 | A | | 7/1983 | Rance | |
| 4,524,533 | A | * | 6/1985 | Still, Jr. | 40/607.06 |
| 4,623,073 | A | | 11/1986 | Hansen | |
| 4,717,110 | A | * | 1/1988 | Fohrman | 248/545 |
| D297,691 | S | | 9/1988 | Hughes | |
| 4,790,092 | A | * | 12/1988 | Farmer | 40/607.09 |
| 4,793,083 | A | * | 12/1988 | McDonald | 40/606.13 |
| 4,821,440 | A | | 4/1989 | Dunn | |
| 4,910,901 | A | * | 3/1990 | Boyar | 40/607.06 |
| D315,045 | S | | 2/1991 | Vanaman | |
| 5,011,039 | A | | 4/1991 | Crow | |
| 5,054,862 | A | | 10/1991 | Vanaman | |
| D322,529 | S | | 12/1991 | Zajac | |
| 5,088,672 | A | | 2/1992 | Neuendorf et al. | |
| D326,789 | S | | 6/1992 | Davis | |
| D329,467 | S | | 9/1992 | Petersen | |
| 5,181,335 | A | * | 1/1993 | Todd | 40/606.13 |
| 5,230,176 | A | * | 7/1993 | Schomaker | 40/607.11 |
| 5,267,643 | A | | 12/1993 | Scribner | |
| 5,273,246 | A | * | 12/1993 | Stahara et al. | 248/218.4 |
| 5,319,870 | A | * | 6/1994 | Weiss | 40/606.14 |
| 5,595,300 | A | * | 1/1997 | Paik et al. | 206/449 |
| 5,664,851 | A | * | 9/1997 | Dunn | 312/102 |
| 5,894,931 | A | * | 4/1999 | Dunn | 206/555 |
| 6,012,786 | A | | 1/2000 | Dunn | |
| D434,083 | S | | 11/2000 | Vance | |
| 6,618,974 | B2 | | 9/2003 | Szalay | |
| D485,312 | S | | 1/2004 | Gaska et al. | |
| 6,709,184 | B1 | | 3/2004 | McDonald | |
| 6,860,573 | B2 | | 3/2005 | Dunn et al. | |
| 6,976,660 | B2 | | 12/2005 | Lapointe et al. | |
| 7,246,738 | B2 | * | 7/2007 | Jonas | 232/45 |
| 7,404,532 | B1 | * | 7/2008 | Baril | 248/218.4 |
| 7,513,471 | B2 | * | 4/2009 | Moufflet | 248/218.4 |
| 7,694,447 | B1 | * | 4/2010 | Rutler et al. | 40/654.01 |
| 7,748,149 | B1 | * | 7/2010 | Reavis | 40/566 |
| 2005/0262744 | A1 | | 12/2005 | Tollis | |

* cited by examiner

CONTAINER AND UNIVERSAL BRACKET SYSTEM

TECHNICAL FIELD

The invention relates generally to an apparatus for securing a container to an upstanding support and, more particularly, to a universal bracket system for securing an outdoor document storage container to one of several upstanding supports.

BACKGROUND

In the marketing of real estate property, it is important to provide documents containing facts related to the property to potential buyers. It is necessary to leave the documents in containers in the front of homes in a manner that is readily accessible to the potential buyer. Since the documents are typically paper products, they are subject to damage by the elements, particularly by moisture. As a result, real estate document containers need to be both water resistant to protect the materials and easily accessible.

Real estate document containers need to be supported in some manner. Numerous solutions to this problem have been developed. One popular method is to provide a spike attached to the back of the container which can penetrate the soil of the yard, thus supporting the container upright in the yard. A more preferred means of support is to attach the document container to the real estate yard sign that is advertising the property for sale. The problem with this method is that there are numerous configurations for the signs, and there is no universal method of attaching to them.

SUMMARY

The present invention provides a universal bracket system for securing an outdoor document storage container to different upstanding supports that are commonly used in the real estate and outdoor sign industries.

In a preferred embodiment, a container has a box portion with a pivotal lid, and a bracket system extending from the back of the box portion. The bracket system comprises an upper bracket having a generally inverted u-shape, with an interior channel. A central bracket extends from the box portion at a position below the upper bracket. The central bracket has a pair of hollow posts and a central flange extending between the hollow posts. A u-shaped notch is located on the central flange in alignment with the channel of the upper bracket.

A lower bracket extends from the box portion at a position below the central bracket. The lower bracket has a pair of posts and a lower flange extending between the posts. A u-shaped notch is located on the lower flange in alignment with the notch of the central bracket and the channel of the upper bracket.

In a more preferred embodiment, a bevel is located on each of the upper edges of the notches in the central and lower brackets. A plurality of supports may be provided that extend outward from the container, orthogonal to the flange of the central and lower brackets.

In the preferred embodiment, there is a pair of outermost supports located opposite the hollow posts of the central bracket, with a hole extending through each outermost support. There may also be a pair of outermost supports located opposite the posts of the lower bracket, with a hole extending through each outermost support.

Also in the preferred embodiment, a centermost support extends perpendicular from the bottom of the notch on each of the central and lower brackets. A generally semicircular relief extends across each centermost support and flange in substantial alignment with the channel.

As described, the bracket system permits attachment of the container to a plurality of upstanding outdoor supports including posts, angle iron, and signs supported in rectangular and cylindrical frameworks. Screws can be inserted into the hollow post for attachment to a post. Tying straps, such as twist ties, zip ties, or curling ties, can be inserted through the holes in the supports for attachment of the container to a variety of other supports, such as angle iron.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
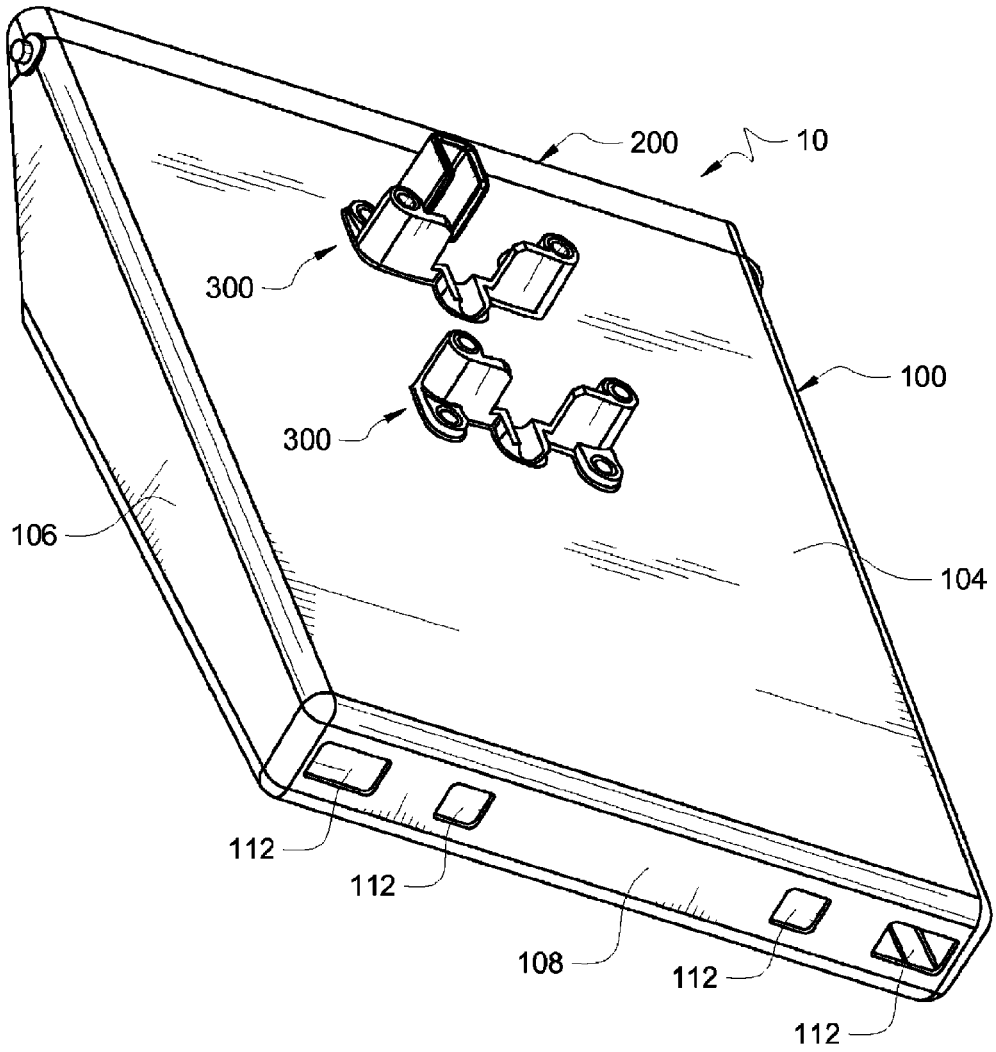
FIG. 1 is an isometric view of the container with a universal bracket system in accordance with a preferred embodiment.

Refer now to the drawings wherein depicted elements are, for the sake of clarity, not necessarily shown to scale and wherein like or similar elements are designated by the same reference numeral through the several views.

Referring to FIGS. 1-13 of the drawings, the reference numeral 10 generally designates a container system for retaining documents which is capable of being attached to the most common upstanding supports used in the real estate industry.

Figure 2:
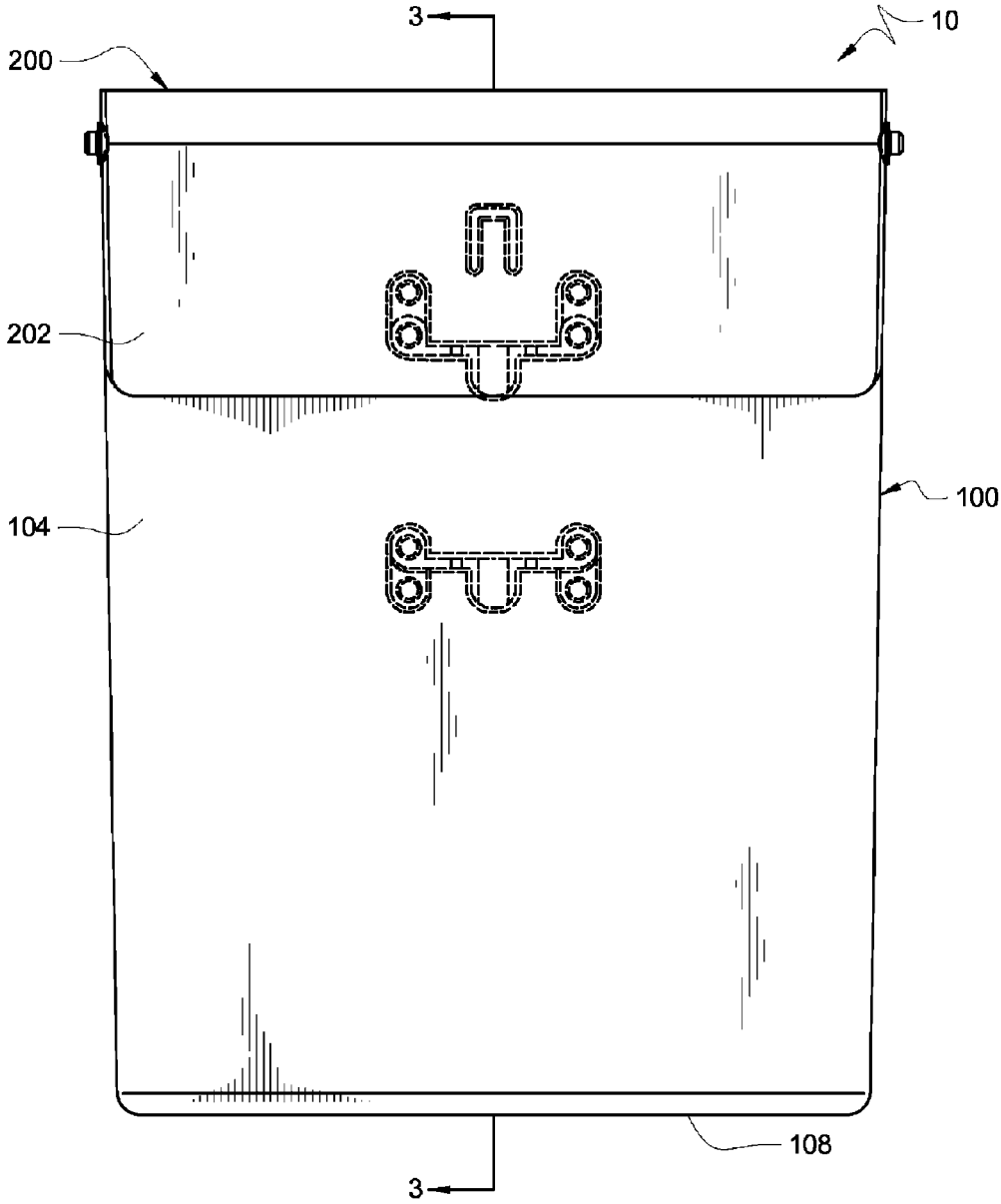
FIG. 2 is a front view of the container in accordance with a preferred embodiment.

FIG. 1 is an isometric view of container 10 in accordance with a preferred embodiment. FIG. 2 is a front view of this embodiment of container 10. As seen in FIGS. 1 and 2, container 10 is generally comprised of a box 100 and a lid 200. A universal bracket system 300 extends from box 100.

Figure 3:
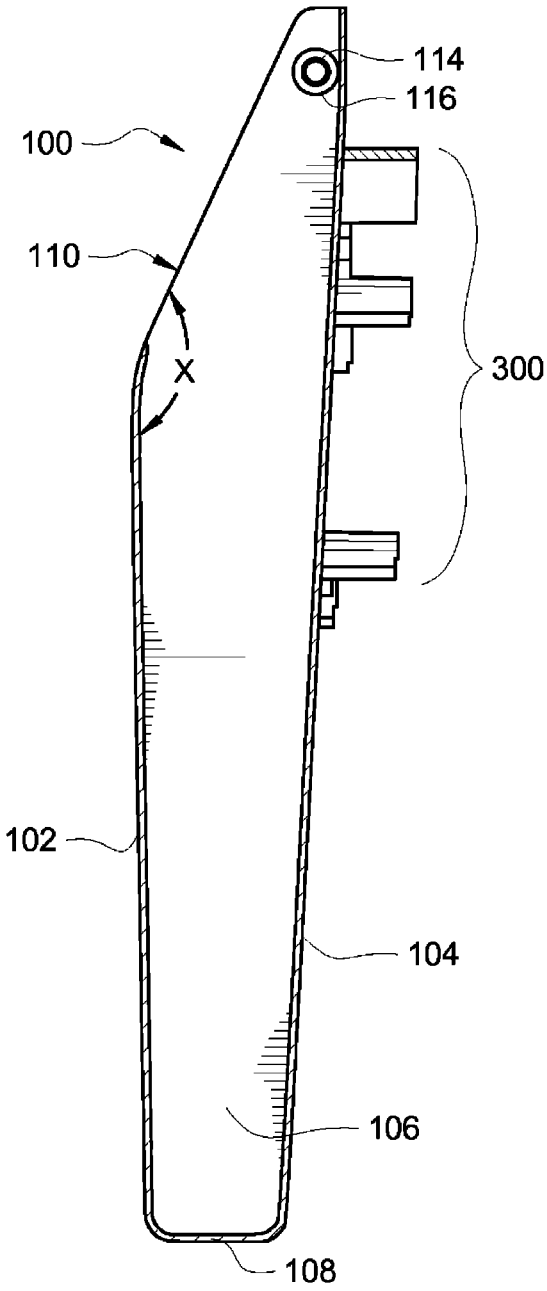
FIG. 3 is a side view of the box portion of the container in accordance with a preferred embodiment.
Figure 4:
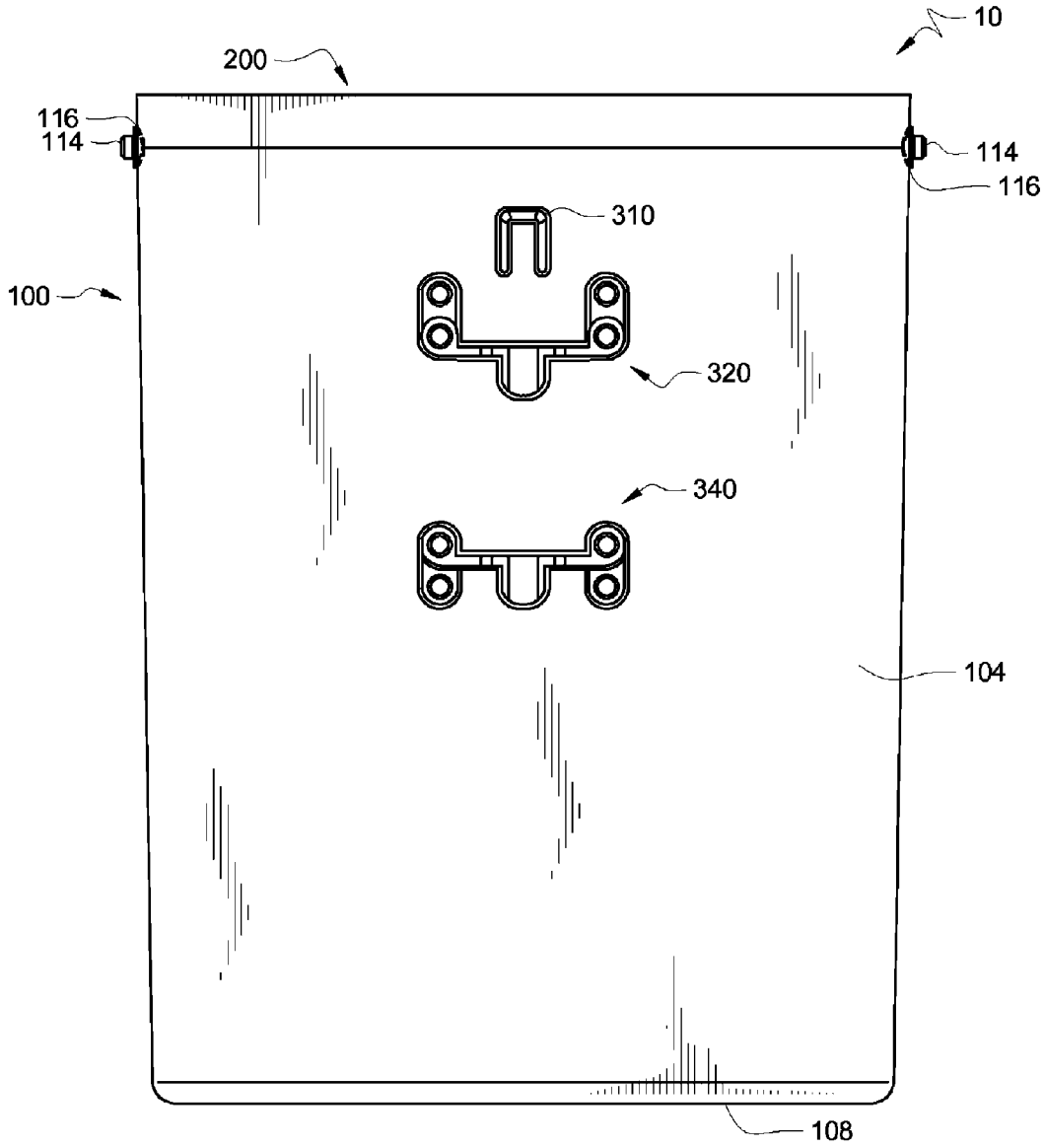
FIG. 4 is a rear view of the box portion of the container in accordance with a preferred embodiment.

FIG. 3 is a side view of box 100 of container 10. FIG. 4 is a rear view of box 100. As seen in FIGS. 2-4, box 100 has a front panel 102 and offset back panel 104. In the preferred embodiment, front panel 102 is made of a transparent material. Front panel 102 and back panel 104 are connected by a pair of opposite side panels 106 and a bottom panel 108. Collectively, front panel 102, back panel 104, side panels 106, and bottom panel 108 form an opening 110 at the top of box 100 through which documents can be placed. In the preferred embodiment, the intersections between front panel 102, back panel 104, side panels 106, and bottom panel 108 are radiused to avoid sharp corners.

As best seen in FIG. 1, bottom panel 108 of box 100 has a plurality of drain holes 112. As best seen in FIG. 3, back panel 104 is longer than front panel 102. Front panel 102 may optionally be inclined slightly away from back panel 104. Opening 110 is downwardly inclined away from back panel 104. An oblique angle X is formed on side panels 106 where front panel 102 meets opening 110. The angular disposition of opening 110 facilitates the handling of documents placed and removed in container 10.

As seen in FIG. 3, a journal 114 extends outward from a position near to the top of each side panel 106. In the preferred embodiment, journals 114 are generally cylindrical. In a more preferred embodiment, a bushing 116 is located between journals 114 and side panels 106.

Figure 5:
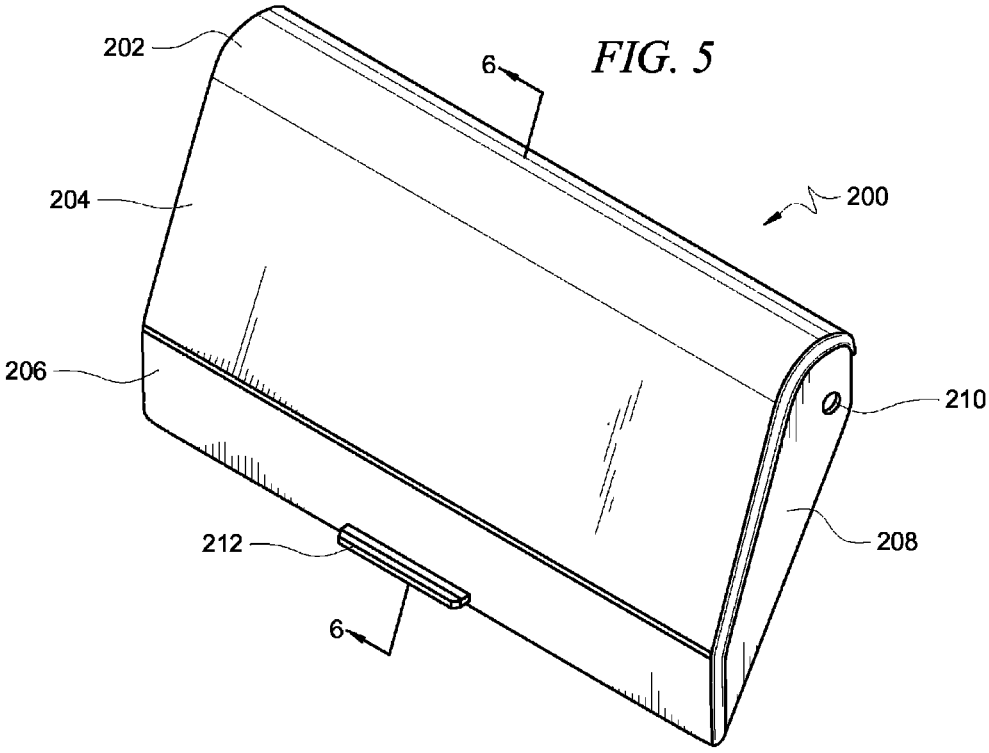
FIG. 5 is an isometric view of the lid portion of the container in accordance with a preferred embodiment.

Referring to FIG. 5, lid 200 has a curved apex section 202 at its top. A substantially rectangular front section 204 extends downward from one side of apex 202. A substantially rectangular lip 206 extends downward from the opposite side of front section 204. In the preferred embodiment, lip 206 is disposed at an angle Y to front section 204. In a more preferred embodiment, angle Y is substantially equal to angle X on side panels 106. By substantially matching angle Y on lid 200 to angle X on box 100, lid 200 can create an effective seal over opening 110 in box 100. A pair of opposing side sections 208 are located along orthogonal edges of each of apex 202, front section 204, and lip 206. A tab 212 may be attached to lip 206.

A portal 210 is located in each side section 208. Portals 210 are receivable of journals 114 to pivotally attach lid 200 to box 100. In the preferred embodiment, portals 210 are smaller in diameter than bushings 116. In this embodiment, bushings 116 support side sections of lid 200 off of side panels 106 of box 100. This permits smooth rotation of lid 200 on journals 114 without friction or interferences between side sections 208 of lid 200 and side panels 106 of box 100. In the preferred embodiment, a tab 212 is formed on the lower edge of lip 206.

Figure 7:
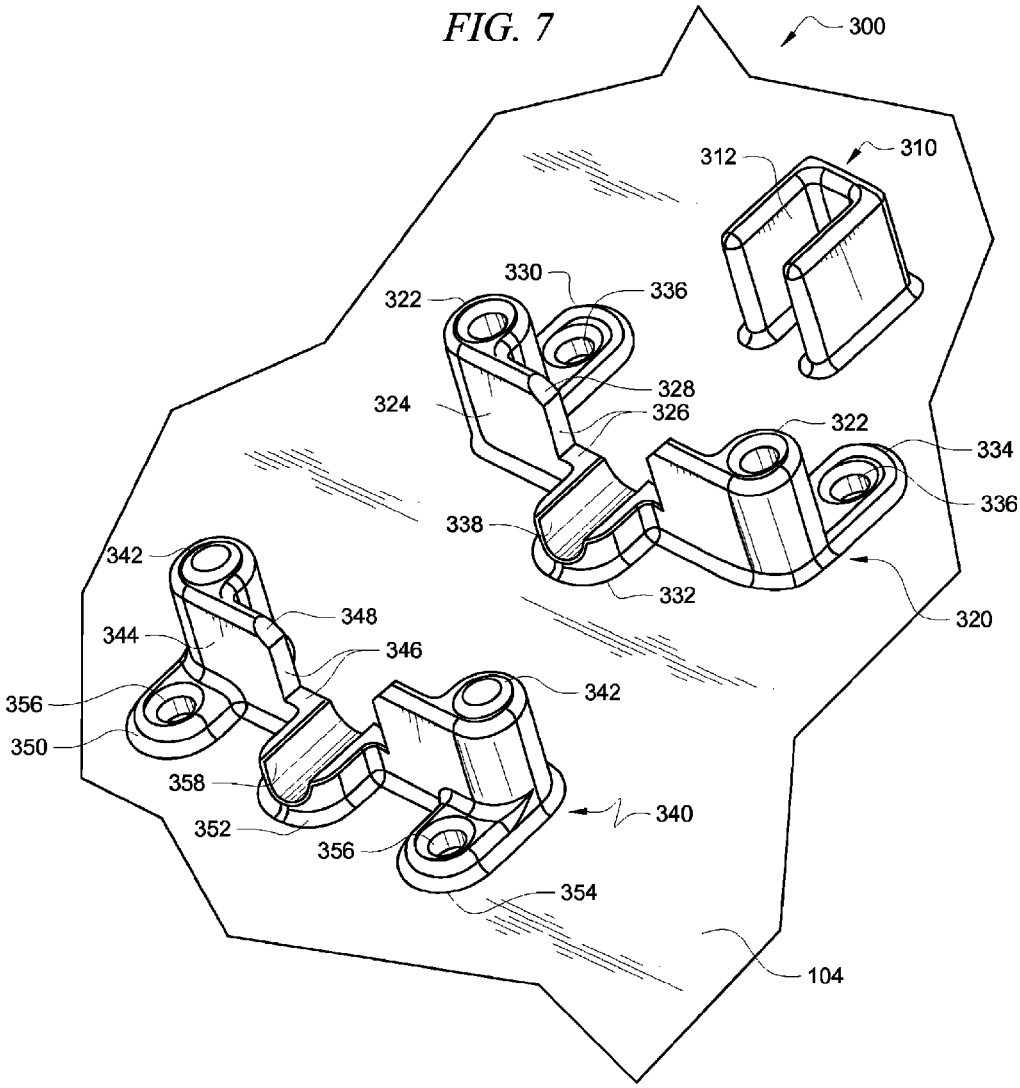
FIG. 7 is an isometric break-out view of the bracket system of the container in accordance with a preferred embodiment.

FIG. 7 is an isometric break-out view of bracket system 300 of container 10 in accordance with a preferred embodiment. Bracket system 300 extends generally perpendicular from back panel 104 of box 100, and is comprised of an upper bracket 310, a central bracket 320, and a lower bracket 340. These three components permit container 100 to be securely attached to multiple upstanding support systems. Bracket system 300 is preferably located centrally (as between side panels 106) and substantially on the upper half of back panel 104 of box 100. Bracket system 300 is preferably formed of an injection molded plastic (such as polypropylene).

Upper bracket 310 is located nearest to the top of container 100. Upper bracket 310 forms a generally inverted U-shape, extending generally perpendicular from back panel 104. A channel 312 is formed on the interior therein facing the direction of central bracket 320 and lower bracket 340. Channel 312 is generally aligned with the centerline of back panel 104 and box 100.

Central bracket 320 is located below upper bracket 310. Central bracket 320 has a pair of hollow posts 322 extending generally perpendicular from back panel 104. Hollow posts 322 are spaced apart and generally symmetric along the centerline of back panel 104 of box 100. The holes in the center of hollow posts 322 preferably penetrate back panel 104. In the preferred embodiment, hollow posts 322 are located within the portion of back panel 104 that is horizontally opposite opening 110 on box 100, above front panel 102. Hollow posts 322 are adapted to receive a screw, nail, bolt, or tying strap. In the preferred embodiment, hollow posts 322 are approximately 2 inches (5 cm) apart.

An upstanding flange 324 extends between hollows posts 322. Flange 324 preferably extends perpendicular from back panel 104. In the preferred embodiment, flange 324 extends between hollows posts 322 on one side, and is substantially tangent with hollow posts 322 on its opposite side. Thus configured, flange 324 provides an upstanding flat surface extending perpendicular to back panel 104.

A notch 326 is located in the middle of flange 324. Notch 326 is generally rectangular and symmetric about the centerline of bracket system 300. Notch 326 is thus generally aligned with channel 312.

In the preferred embodiment, a bevel 328 is located on each of the upper edges of notch 326. Bevels 328 are included to allow bracket system 300 to securely attach container 100 to an upright support made of angle iron. Preferably, the angle of bevels 328, relative to the normal line of back panel 104, is approximately 45°.

In the preferred embodiment, a plurality of supports extend outward from back panel 104, orthogonal to flange 324. In the preferred embodiment illustrated, a triad of supports 330, 332, 334 extend outward from back panel 104, orthogonal to flange 324. The outermost supports 330 and 334 are preferably aligned adjacent to, or opposite, hollow posts 322. A hole 336 is provided in each of supports 330, 334. The centers of holes 336 are preferably collocated to the centers of hollow posts 322 in reference to the centerline of bracket system 300 and penetrate back panel 104. Holes 336 are adapted to receive a screw, nail, bolt, or tying strap. In the preferred embodiment, holes 336 are approximately 2 inches (5 cm) apart.

The centermost support 332 extends perpendicular from the bottom of notch 326 on flange 324. A generally semicircular relief 338 extends across support 332 and flange 324 at the bottom of notch 326. Relief 338 is located on the centerline of bracket system 300 and centrally aligned with channel 312. Relief 338 is adapted to receive a portion of an upstanding support, such as a round post or the corner of an angle iron support. Preferably, the diameter of relief 338 is at least 0.25 inches (0.64 cm).

Lower bracket 340 is located on back panel 104 of box 100. Lower bracket 340 is located below central bracket 320. In the preferred embodiment, lower bracket 340 is configured identically to central bracket 320. In another preferred embodiment, illustrated in FIG. 13, lower bracket 340 is rotated 180° in orientation with respect to central bracket 320.

Lower bracket 340 has a pair of posts 342 extending generally perpendicular from back panel 104 which are spaced apart and generally symmetric along the centerline of bracket back panel 104 and box 100. Posts 342 may or may not be hollow. In the preferred embodiment, posts 342 are approximately 2 inches (5 cm) apart.

An upstanding flange 344 extends between hollow posts 342. Flange 344 preferably extends perpendicular from back panel 104. In the preferred embodiment, flange 344 extends between posts 342 on one side, and is substantially tangent with posts 342 on its opposite side. Thus configured, flange 344 provides an upstanding flat surface extending perpendicular to back panel 104.

A notch 346 is located in the middle of flange 344. Notch 346 is generally rectangular and symmetric about the centerline of bracket system 300. Notch 346 is thus generally aligned with channel 312.

In the preferred embodiment, a bevel 348 is located on each of the upper edges of notch 346. Bevels 348 are included to allow bracket system 300 to securely attach container 100 to an upright support made of angle iron. Preferably, the angle of bevels 348, relative to the normal line of back panel 104, is approximately 45°.

In the preferred embodiment, a plurality of supports extend outward from back panel 104, orthogonal to flange 344. In the preferred embodiment illustrated, a triad of supports 350, 352, 354 extend outward from back panel 104, orthogonal to flange 344. The outermost supports 350 and 354 are preferably aligned opposite posts 342. A hole 356 is provided in each of supports 350, 354. The centers of holes 356 are preferably collocated to the centers of posts 342 in reference to the centerline of bracket system 300. Holes 356 penetrate back panel 104. Holes 356 are adapted to receive a screw, nail, bolt, or tying strap. In the preferred embodiment, holes 356 are approximately 2 inches (5 cm) apart.

The centermost support 352 extends perpendicular from the bottom of notch 346 on flange 344. A generally semicircular relief 358 extends across support 352 and flange 344 at the bottom of notch 346. Relief 358 is located on the centerline of bracket system 300 and centrally aligned with channel 312. Relief 358 is adapted to receive a portion of an upstanding support, such as a round post or the corner of an angle iron support. Preferably, the diameter of relief 358 is at least 0.25 inches (0.64 cm).

In the preferred embodiment illustrated, hollow posts 322 of central bracket 320 are aligned tangent to, and above, flange 324. In this same embodiment, posts 342 of lower bracket 340 are similarly aligned tangent to, and above, flange 344. In a more preferred configuration of this embodiment, the distance between flange 324 of central bracket 320 and posts 342 of lower bracket 340 is between approximately 2 inches and 3 inches (5 cm and 8 cm).

In the preferred embodiment, the outward extension from back panel 104 of upper bracket 310, central bracket 320, and lower bracket 340, are all substantially the same.

Figure 8:
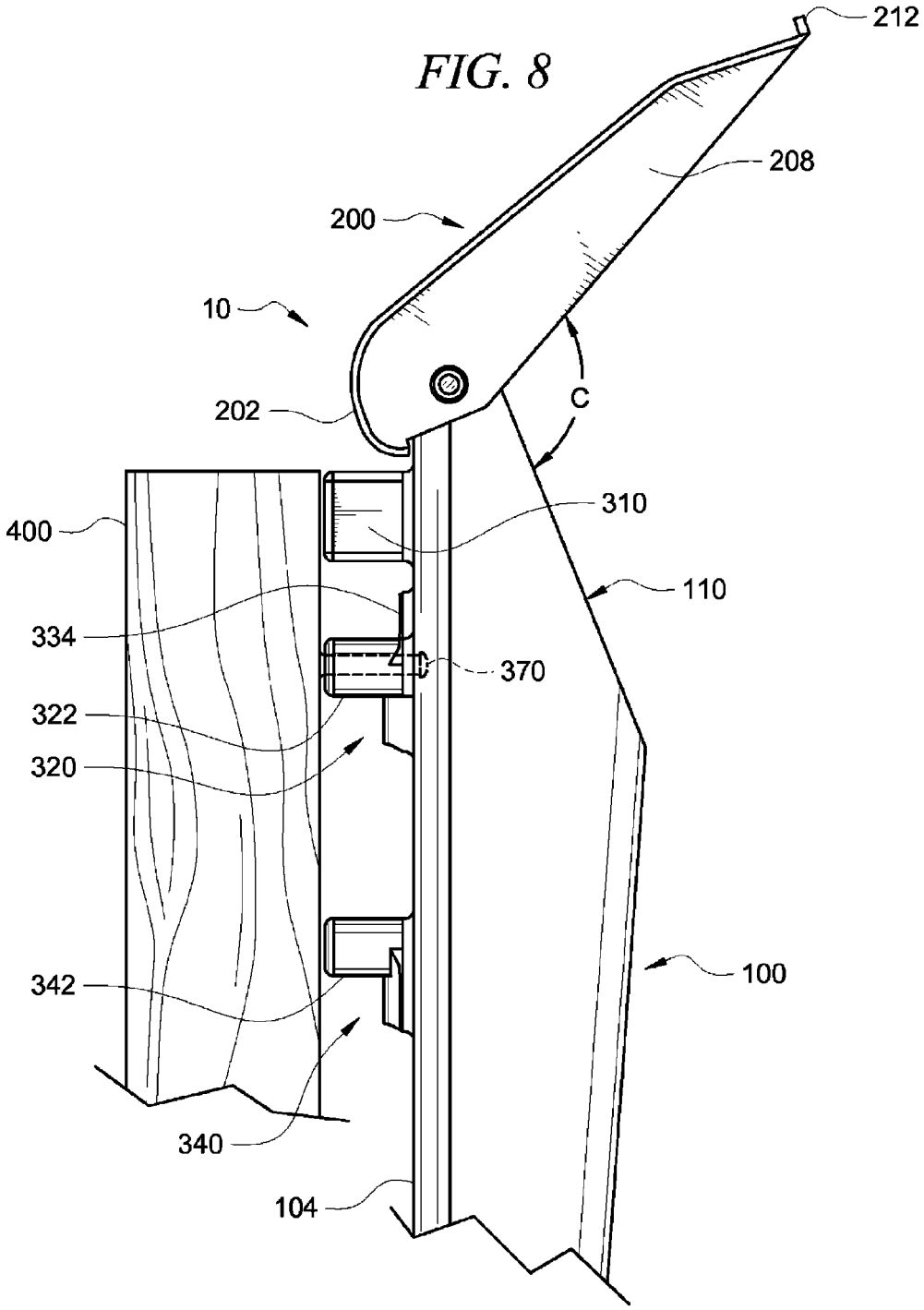
FIG. 8 is a side view of the container, illustrating the lid in the fully opened position, with the bracket system attached to a vertical post.

Referring to FIG. 8, a side view of container 10 illustrates the bracket system 300 attached to a vertical post 400, and with lid 200 in the fully opened position relative to box 100. From this illustration, it is seen that pivotal rotation of lid 200 is limited by engagement of apex section 202 of lid 200 with back panel 104 of box 100. In the preferred embodiment, this engagement of apex 202 with back panel 104 occurs at a position in which the center mass of lid 200 is sufficiently forward of journals 114 such that lid 200 will fall closed under its own weight when container 10 is mounted levelly. In a preferred embodiment, lid 200 has a rotational range of between approximately 90 and 140 degrees.

In an alternative embodiment, illustrated in FIG. 13, posts 342 of lower bracket 340 are aligned tangent to, and below, flange 344. Also in this embodiment, centermost support 332 extends upward in the direction of upper bracket 310. In this manner of alignment, the flat surface of flanges 324 and 344 may be aligned over a horizontal post for more secure attachment. In a more preferred configuration of this embodiment, the distance between flange 324 of central bracket 320 and flange 344 of lower bracket 340 is approximately 2 inches (5 cm).

This is just one example of the many ways the elements of the present invention can be alternatively configured without departing from the spirit of the invention.

In another preferred embodiment, not illustrated, a hook and loop assembly is attached between lip 206 of lid 200 and front panel 102 of box 100. In another preferred embodiment, also not illustrated, stiffening ribs are located on front panel 102 of box 100.

Figure 14:
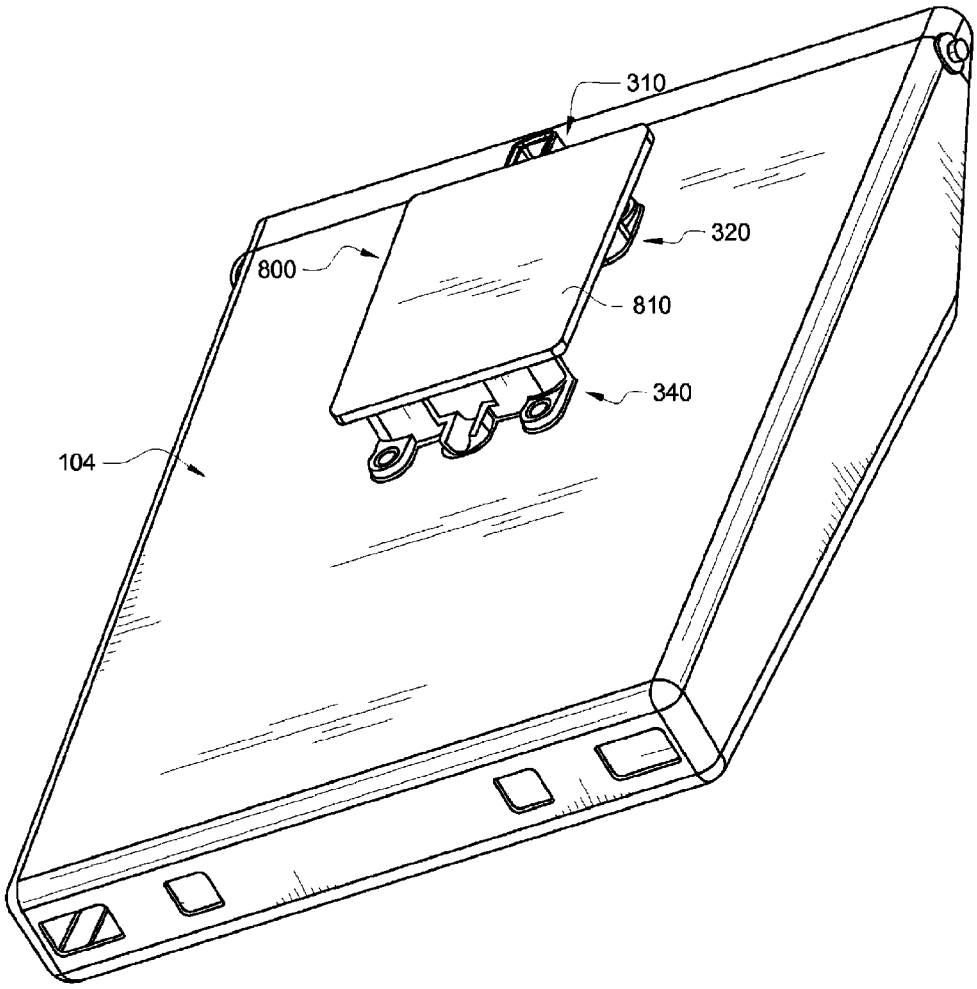
FIG. 14 is an isometric view of the box portion of the container, illustrating an optional adapter attached to the bracket system.
Figure 15:
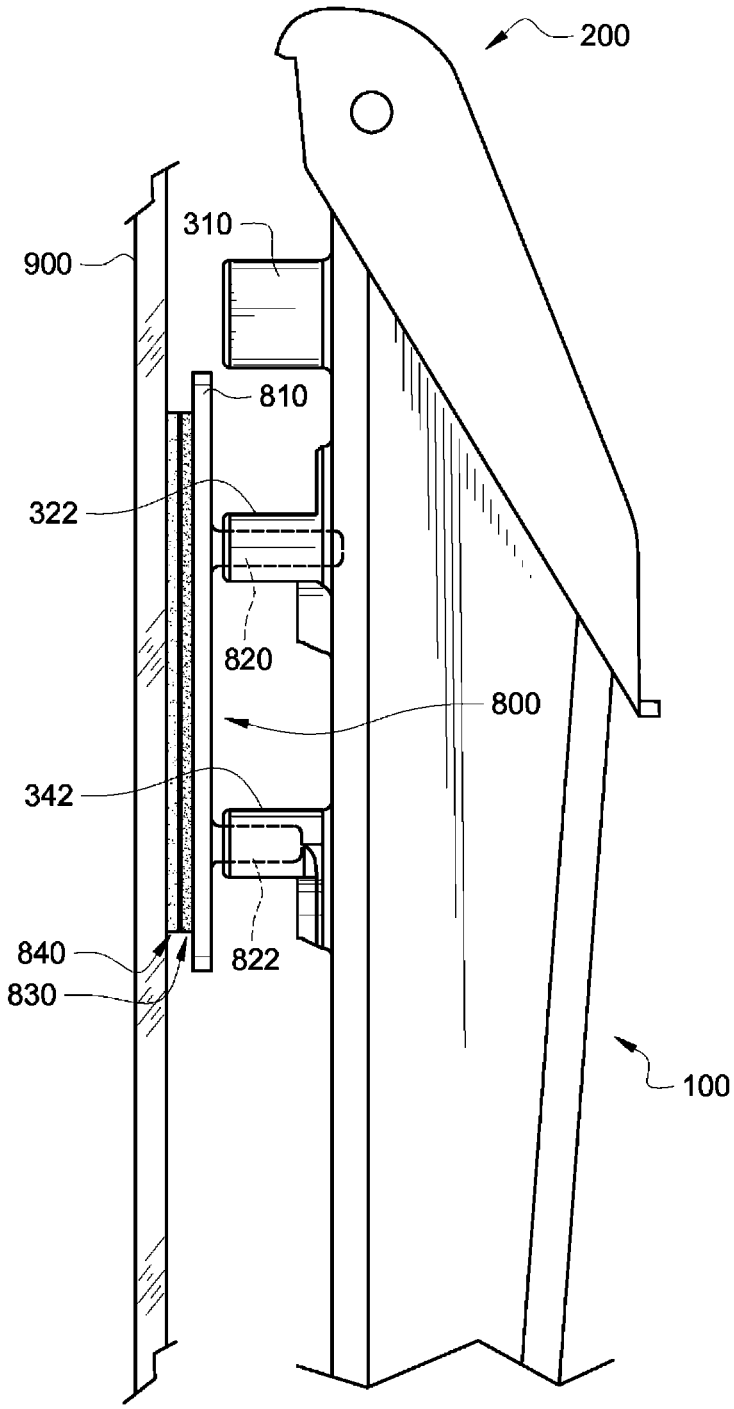
FIG. 15 is a side view of the container system having the adapter attached, illustrating the adapter engaging a pane of glass to support the container.

Referring to FIG. 14, an optional adapter 800 is disclosed. Adapter 800 has a flat base portion 810. Referring to FIG. 15, studs 820 extend substantially perpendicular from base 810. Studs 822 also extend substantially perpendicular from base 810, beneath studs 820.

In the preferred embodiment, studs 820 and 822 are formed integral with base 810. Studs 820 are sized for insertion into the interior of hollow posts 322 of central bracket 320 in interference fit. In the preferred embodiment, posts 342 of lower bracket 340 are also hollow. Studs 822 are received into the interior of hollow posts 342 of lower bracket 340 in interference fit. To accomplish attachment, studs 820 are configured on base 810 for centered alignment with hollow posts 322 and studs 822 are configured on base 810 for centered alignment with hollow posts 342.

In a more preferred embodiment, the hole in hollow posts 342 is a blind hole that does not extend through back panel 104 of box 100. FIG. 15 further illustrates adapter 800 engaging a pane of glass 900. A hook portion 830 of a Velcro™ type hook and loop assembly is attached to base 810 of adapter 800. A complementary loop portion 840 is attached to a flat receiving surface such as glass pane 900. It will be readily appreciated that either portion of the hook 830 and loop 840 assembly can be attached to either adapter 800 or glass 900, and glass 900 can be any generally flat surface.

As the terms are used in this specification and claims, the words "generally" and "substantially" are intended to be words of approximation, meaning "largely but not necessarily entirely."

Operation

FIGS. 1-4 illustrate various views of a preferred embodiment of the container 10 of the present invention. As seen in these figures, universal bracket system 300 extends from box 100 portion of container 10.

Box 100 and lid 200 of container 10 are preferably made of an injection molded plastic (such as polypropylene). Also in the preferred embodiment, box 100 is made of a translucent or transparent material such that a person approaching container 10 can tell if it has any documents remaining inside. Bracket system 300 is preferably formed integrally with back panel 104 of box 100.

As best seen in FIG. 1, bottom panel 108 of box 100 has a plurality of drain holes 112. These holes allow any moisture that might accumulate inside box 100 to drain out.

As best seen in the preferred embodiment illustrated in FIG. 3, front panel 102 may optionally be upwardly inclined away slightly from back panel 104. In this configuration, documents can be separated at their top to facilitate grasping of a single document, even when box 100 is filled to capacity as dictated by the width of bottom panel 108.

An oblique angle X is formed on side panels 106 where front panel 102 meets opening 110 such that opening 110 is downwardly inclined away from back panel 104. The angular disposition of opening 110 facilitates the insertion, separation, and removal of documents into and out of container 10.

As best seen in FIGS. 3-5, box 100 and lid 200 are configured for pivotal relationship. In the preferred embodiment illustrated in FIG. 3, bushing 116 and journal 114 extend outward from a position near to the top of each side panel 110. Bushings 116 are located between journals 114 and side panels 106. A portal 210 is located in each side section 208 for receiving journals 114. In the preferred embodiment, portals 210 are smaller in diameter than bushings 116 so that bushings 116 support side sections of lid 200 off of side panels 106 of box 100. This permits smooth rotation of lid 200 on journals 114 without friction or interference between side sections 208 of lid 200 and side panels 106 of box 100.

Figure 6:
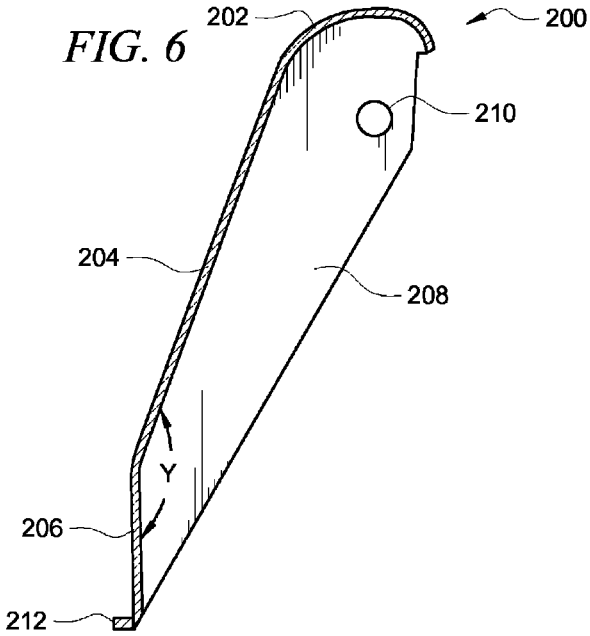
FIG. 6 is a side view of the lid portion of the container in accordance with a preferred embodiment.

In the preferred embodiment illustrated in FIG. 6, lip 206 is disposed at an angle Y to front section 204 that is near to angle X on side panels 106 of box 100. By generally matching angle Y on lid 200 to angle X on box 100, lid 200 can create an effective seal over opening 110 in box 100.

As best seen in FIG. 5, tab 212 may be formed on the lower edge of lip 206 to permit easy grasping and rotation of lid 200 to gain access to the interior of box 100.

Referring to FIG. 8, a side view of container 10 is illustrated with bracket system 300 attached to vertical post 400, and with lid 200 in the fully opened position relative to box 100. The pivotal rotation of lid 200 is limited by engagement of apex section 202 of lid 200 with back panel 104 of box 100.

In the preferred embodiment, the engagement of apex 202 with back panel 104 occurs at a position in which the center mass of lid 200 is sufficiently forward of journals 114 such that lid 200 will fall closed under its own weight when container 10 is mounted levelly. This functionality prevents accidental failure to close lid 200, and from the wind blowing lid 200 into a continuously open position such that the contents of container 10 remain exposed to the elements. To provide this functionality and still maintain easy access to documents, in a preferred embodiment, lid 200 has a rotational range of between approximately 90 and 140 degrees.

Still referring to FIG. 8, it is seen that having the outward extension from back panel 104 of upper bracket 310, central bracket 320, and lower bracket 340 substantially the same provides a level, secure mounting of container 10 offset to a post 400, stabilized by contact with each of upper bracket 310, central bracket 320, and lower bracket 340.

Still referring to FIG. 8, central bracket 320 is seen located within the portion of back panel 104 that is horizontally opposite opening 110 on box 100. By locating hollow posts 322 of central bracket 320 opposite opening 110, access is provided for tools needed to rotate mechanical fasteners 370 located in hollow posts 322. As seen in FIG. 8, this provides a means of attachment of container 10 to post 400, or a fence or similar structure.

Figure 9:
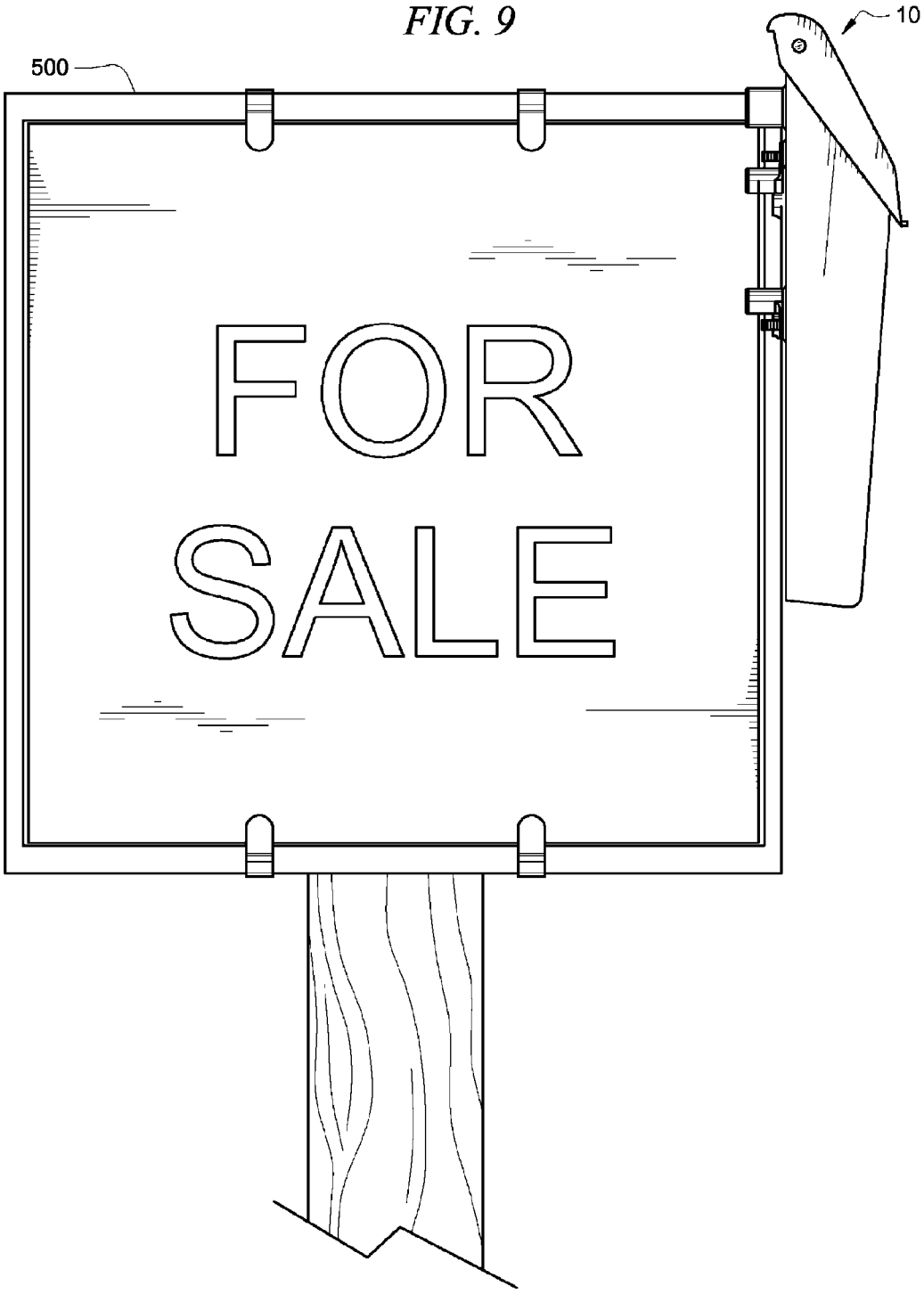
FIGS. 9 and 10 are side views of the container, illustrating the lid in the closed position, with the bracket system attached to the cylindrical frame portion of an outdoor sign.
Figure 10:
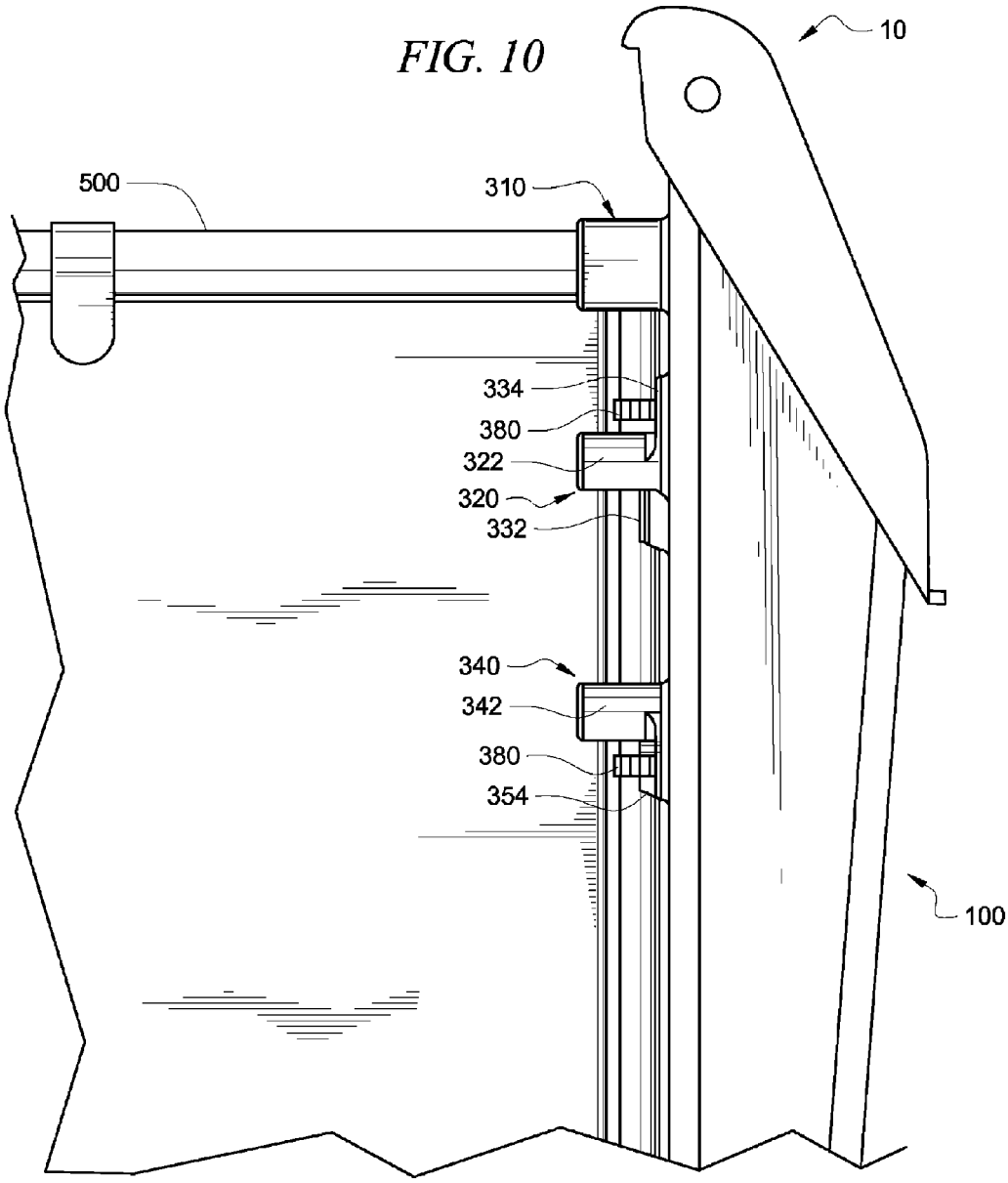

FIGS. 9 and 10 are side views of container 10 attached to the cylindrical frame portion 500 of an outdoor sign. In FIG. 10, it can be seen that the cylindrical frame portion 500 of a conventional outdoor real estate sign fits into channel 312 of upper bracket 310. Upper bracket 310 thus secures container 10 centrally on frame 500 and prevents downward movement of container 10 relative to frame 500.

Still referring to FIG. 10, cylindrical frame portion 500 also fits into generally semicircular reliefs 338 and 358 of central and lower brackets 320 and 340, respectively. In this manner, each component of bracket system 300 engages frame 500. Tying straps 380, such as twist ties, zip ties, or curling ties, can be inserted through holes 336 and 356 and around frame 500 to secure container 10 on frame 500 of the sign.

Figure 11:
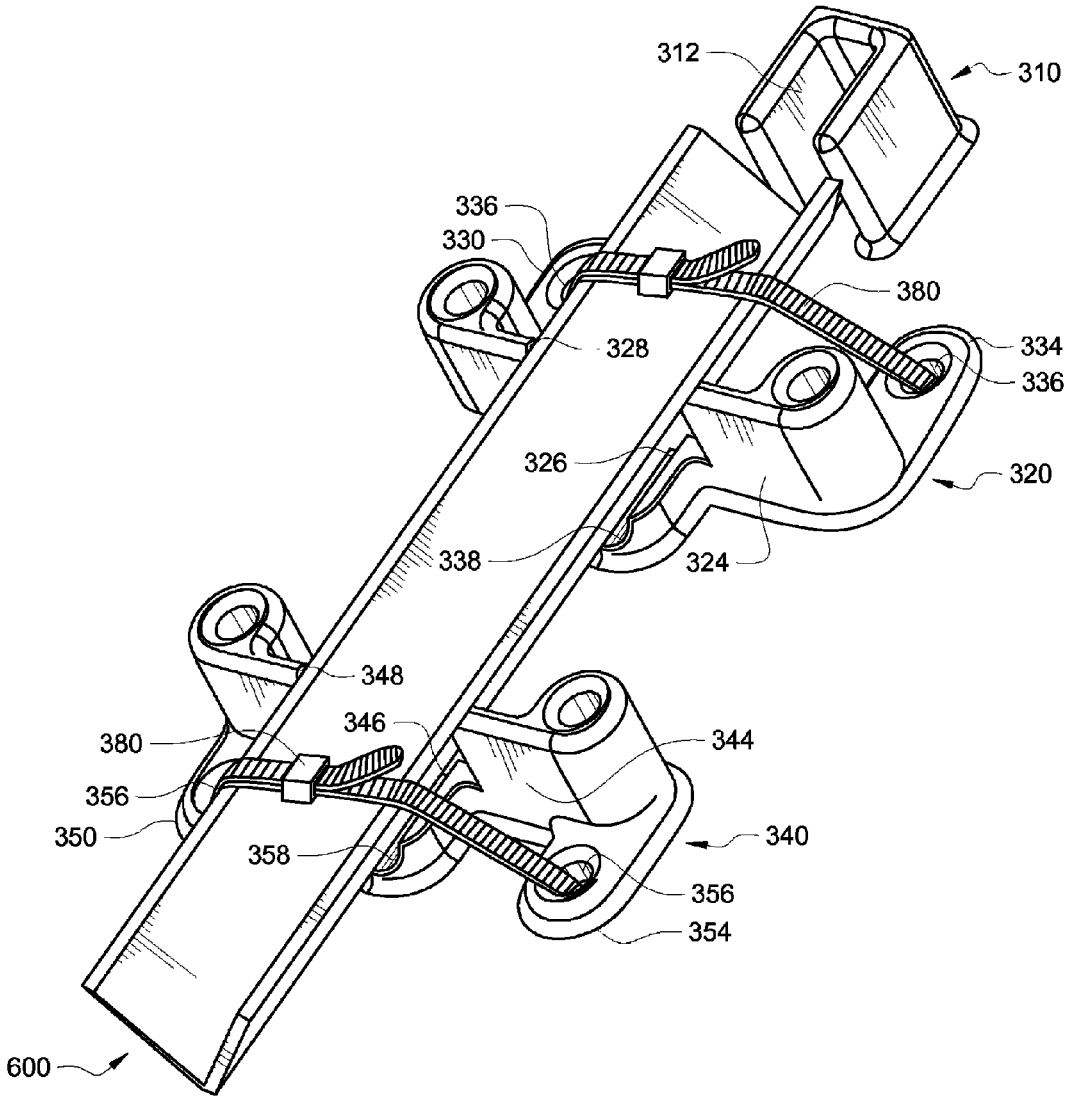
FIG. 11 is an isometric view of the bracket system of the container in accordance with a preferred embodiment of the present invention, illustrating the bracket system engaging an angle iron support.

FIG. 11 is an isometric view of bracket system 300 of container 10, illustrating the engagement of bracket system 300 with a conventional angle iron support 600. In FIG. 11, it can be seen that angle iron support 600 engages the bottom of upper bracket 310, without going into channel 312. Upper bracket 310 thus prevents downward movement of container 10 relative to angle iron 600.

Still referring to FIG. 11, it is seen that angle iron 600 is located inside notches 326 and 346 of central and lower brackets 320, 340, respectively. In this position, angle iron 600 is engaged at three points within each of central and lower brackets 320, 340. More precisely, the corner of angle iron 600 is centered in each of generally semicircular reliefs 338, 358 of central and lower brackets 320 and 340, respectively, and rest against opposing bevel pair 328 and opposing bevel pair 348 in central and lower brackets 320 and 340, respectively. Preferably, the angle of bevels 328 and 348 relative to the normal line of back panel 104 is approximately 45°, which provides a plane of contact parallel to the surfaces of angle iron 600, thus centering and securing angle iron 600 in place.

Tying straps 380 such as twist ties, zip ties, or curling ties, can be inserted through holes 336 and 356 and around angle iron 600 to secure container 10 on angle iron 600. The three point contact centers and stabilizes container 10 on angle iron 600.

Figure 12:
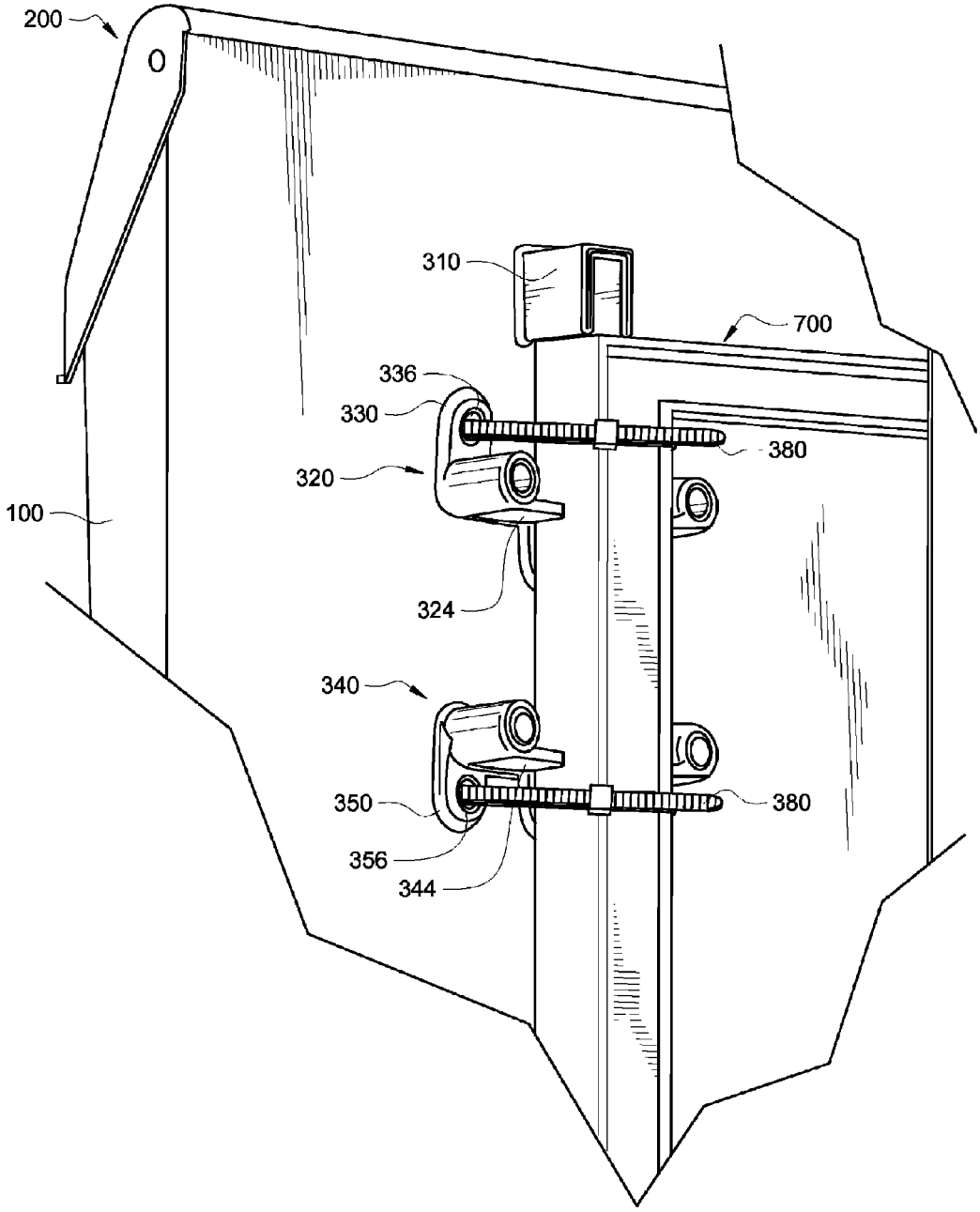
FIG. 12 is an isometric cut-out view of the bracket system of the container in accordance with a preferred embodiment of the present invention, illustrating the bracket system engaging a rectangular frame portion of an outdoor sign.

FIG. 12 is an isometric cut-out view of bracket system 300 of container 10 illustrating the engagement of bracket system 300 with a rectangular frame portion 700 of a conventional outdoor sign. In FIG. 12, it can be seen that rectangular frame 700 engages the bottom of upper bracket 310, without going into channel 312. Upper bracket 310 thus prevents downward movement of container 10 relative to rectangular frame 700.

Still referring to FIG. 12, it is seen that rectangular frame 700 is located inside notches 326 and 346 of central and lower brackets 320 and 340, respectively. In this position, rectangular frame 700 is securely engaged on three sides within each of central and lower brackets 320 340.

Tying straps 380, such as twist ties, zip ties, or curling ties, can be inserted through holes 336 and 356 and around rectangular frame 700 to secure container 10 on rectangular frame 700. The three-sided contact within each of central and lower brackets 320 and 340, centers and stabilizes container 10 on rectangular frame 700. Although container 10 is illustrated as side-mounted in FIG. 12 on rectangular frame 700, it is appreciated that container 10 could be similarly end-mounted on rectangular frame 700.

Referring back to FIG. 7, an isometric break-out view of bracket system 300 of container 10 is illustrated in accordance with a preferred embodiment. Bracket system 300 extends generally perpendicular from back panel 104 of box 100, and is comprised of an upper bracket 310, a central bracket 320, and a lower bracket 340. These three components permit container 100 to be securely attached to multiple upstanding support systems. Bracket system 300 is preferably located centrally (as between side panels 106), and substantially on the upper half of back panel 104 of box 100. Bracket system 300 is preferably formed of an injection molded plastic (such as polypropylene).

In the preferred embodiment, a plurality of supports extend outward from back panel 104. In the preferred embodiment illustrated, a triad of supports 330, 332, 334 extend outward from back panel 104 on central bracket 320, and a triad of supports 350, 352, 354 extend outward from back panel 104 on lower bracket 340.

Outermost supports 330, 334, 350 and 354 provide sufficient material thickness for the location of holes 336 and 356. They also stiffen back panel 104 and reduce flexing of flanges 324 and 344 relative to back panel 104. In the preferred embodiment, holes 336 and 356 are each spaced approximately 2 inches (5 cm) apart.

Centermost supports 332 and 352 extend outward from back panel 104, perpendicularly. In the preferred embodiment, centermost supports 332 and 352 extend from the bottom of notches 326 and 346 on central bracket 320 and lower bracket 340, respectively. They may extend upwards or downwards.

Centermost supports 332 and 352 provide sufficient material thickness for the location of reliefs 338 and 358. They also stiffen back panel 104 and reduce flexing of flanges 324 and 344 relative to back panel 104. In the preferred embodiment, centermost supports 332 and 352 are centrally aligned with channel 312 to cooperatively receive components of various upstanding support structures.

Figure 13:
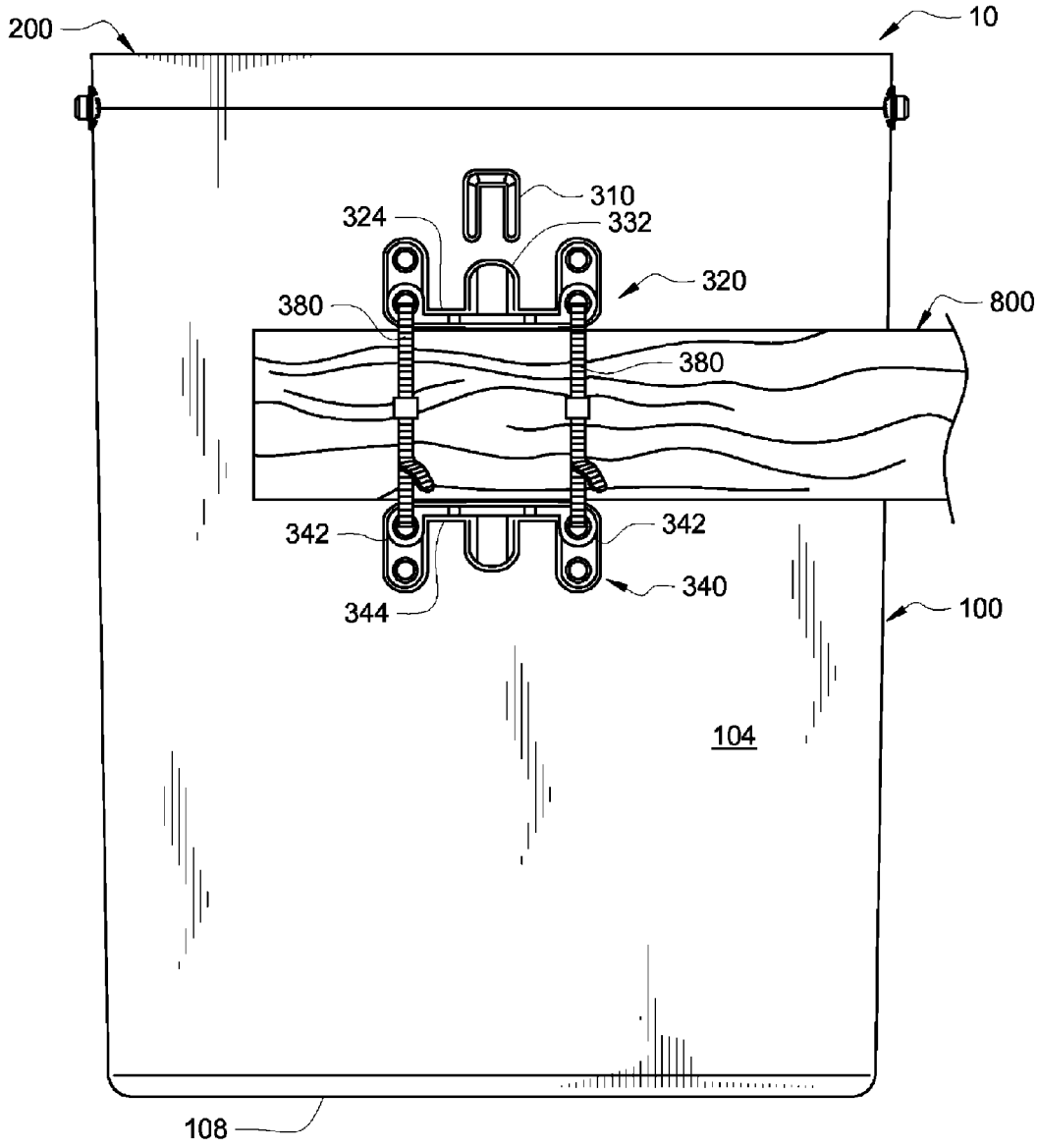
FIG. 13 is a rear view of the box portion of the container, illustrating an alternative embodiment of the bracket system.

FIG. 13 is a rear view of container 10, illustrating an alternative embodiment of bracket system 300 as attached on a horizontal post 800. In this embodiment, posts 342 of lower bracket 340 are aligned tangent to, and below, flange 344. Also in this embodiment, centermost support 332 extends upward in the direction of upper bracket 310. In this configuration, flange 324 forms the bottom of central bracket 320, and flange 344 forms the top of lower bracket 340 such that the flat surfaces of flanges 324 and 344 oppose each other to facilitate alignment on a horizontal post. In a more preferred configuration of this embodiment, the distance between flange 324 of central bracket 320 and flange 344 of lower bracket 340 is approximately 2 inches (5 cm).

As with the other embodiments, tying straps 380 such as twist ties, zip ties, or curling ties, can be inserted through holes 336 and 356 and around post 800 to secure container 10 on post 800.

In another preferred embodiment, not illustrated, a hook and loop assembly is attached between lip 206 of lid 200 and front panel 102 of box 100. In another preferred embodiment, also not illustrated, stiffening ribs are located on front panel 102 of box 100 to add rigidity to box 100.

As illustrated in FIGS. 14 and 15, optional adapter 800 provides a means for attaching container system 10 to a generally flat surface such as glass 900. This permits attachment of container system 10 to the window of a car, house, or store, or any other generally flat surface. In the preferred embodiment, posts 342 of lower bracket 340 are hollow for receiving studs 822. In the more preferred embodiment, the hollow center of hollow posts 342 does not extend through back panel 104 of box 100. This blind-hole configuration prevents moisture from entering box 100 through hollow posts 342 when container system 10 is not mated to adapter 800.

The interference fit of studs 820 inside hollow posts 322 and studs 822 inside hollow posts 342 permits secure attachment of adapter 800 to box 100 without the use of adhesive. The use of hook 830 and loop 840 assembly permits removable attachment of container system 10 to virtually any generally flat surface.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

We claim:

1. A bracket system for a document container comprising:
an upper bracket extending from the document container;
a central bracket extending from the container at a position below the upper bracket, having a pair of hollow posts, a central flange extending between the hollow posts, a U-shaped notch in the central flange, and a channel in general alignment with the notch;
a lower bracket extending from the container at a position below the central bracket, having a pair of posts, a lower flange extending between the posts, a U-shaped notch in the lower flange, and a channel in general alignment with the notch; and,
wherein the upper, central, and lower brackets are integrally molded on a common surface.

2. The bracket system of claim 1, further comprising:
a bevel located on each of the upper edges of the notches in the central and lower brackets.

3. The bracket system of claim 1, further comprising:
a plurality of supports extending outward from the container, orthogonal to the flange.

4. The bracket system of claim 1, the central bracket further comprising:
a pair of outermost supports extending outward from the container, orthogonal to the flange, and opposite the hollow posts; and,
a hole extending through each outermost support.

5. The bracket system of claim 1, the central bracket further comprising:
a centermost support extending perpendicular from the bottom of the notch; and,
a generally semicircular relief extending across the centermost support and the flange in substantial alignment with the channel.

6. The bracket system of claim 1, the lower bracket further comprising:
a pair of outermost supports extending outward from the container, orthogonal to the flange, and opposite the posts; and,
a hole extending through each outermost support.

7. The bracket system of claim 1, the lower bracket further comprising:
a centermost support extending perpendicular from the bottom of the notch; and,
a generally semicircular relief extending across the centermost support and the flange in substantial alignment with the channel.

8. The bracket system of claim 1, further comprising:
the posts of the lower bracket have blind holes therein.

9. The bracket system of claim 1, further comprising:
the upper bracket having a generally inverted u-shape, with an interior channel.

10. The bracket system of claim 1, further comprising:
the surface being a surface of the container.

* * * * *